US009533402B2

(12) United States Patent
Fontan Guzman et al.

(10) Patent No.: US 9,533,402 B2
(45) Date of Patent: Jan. 3, 2017

(54) HYDRAULICALLY OPERATED TIGHTENING TOOL

(75) Inventors: Marcos Fontan Guzman, Pontevedra (ES); Christian Leal Touceda, Pontevedra (ES); Pablo Bello Rodriguez, A Coruna (ES); German Jose Rodriguez Novo, A Coruna (ES); Diego Esteban Tapia, A Coruna (ES)

(73) Assignees: ASOCIACION DE INVESTIGACION METALURGICA DEL NOROESTE-AIMEN, Pontevedra (ES); TEXAS CONTROLS, S.L., A Coruna (ES)

( * ) Notice: Subject to any disclaimer, the term of this patent is extended or adjusted under 35 U.S.C. 154(b) by 347 days.

(21) Appl. No.: 14/233,040

(22) PCT Filed: Jul. 16, 2012

(86) PCT No.: PCT/ES2012/070536

§ 371 (c)(1),
(2), (4) Date: May 27, 2014

(87) PCT Pub. No.: WO2013/011183

PCT Pub. Date: Jan. 24, 2013

(65) Prior Publication Data

US 2014/0260815 A1 Sep. 18, 2014

(30) Foreign Application Priority Data

Jul. 15, 2011 (ES) ..... 201131212

(51) Int. Cl.
*B25B 21/00* (2006.01)
*B25B 23/00* (2006.01)

(52) U.S. Cl.
CPC ..... *B25B 21/00* (2013.01); *B25B 21/005* (2013.01); *B25B 23/0064* (2013.01)

(58) Field of Classification Search
CPC ..... B25B 21/00; B25B 21/005; B25B 21/02; B25B 23/10; B25B 23/0064; B23P 19/06
USPC ..... 81/54, 301, 430, 435, 450, 57.39
See application file for complete search history.

(56) References Cited

U.S. PATENT DOCUMENTS 4,201,099 A * 5/1980 Junkers ..... B25B 21/005 81/57.39
4,325,274 A * 4/1982 Martelee ..... B25B 23/145 81/57.13
4,671,142 A * 6/1987 Junkers ..... B25B 13/463 81/57.39

(Continued)

FOREIGN PATENT DOCUMENTS

JP 3 228583 A 10/1991

*Primary Examiner* — Hadi Shakeri
*Assistant Examiner* — Danny Hong
(74) *Attorney, Agent, or Firm* — Lucas & Mercanti, LLP

(57) ABSTRACT

The present invention relates to a hydraulically operated tightening tool comprising a body (1) in which there is assembled a hydraulic cylinder and an actuating ring (6) articulated to the body (1) which receives the action of the piston (3) of the hydraulic cylinder. Two axial tabs protrude from the head of the piston (3) between which tabs there is articulated the actuating ring (6) by means of a shaft with an elastically variable length protruding partially on both sides of the ring. The tabs (7) have transverse facing grooves (16) in which there are housed the ends of the mentioned shaft.

3 Claims, 5 Drawing Sheets

(56) References Cited

U.S. PATENT DOCUMENTS

| | | | | | |
|---|---|---|---|---|---|
| 4,706,527 | A * | 11/1987 | Junkers | B25B 21/005 | 81/57.39 |
| 5,095,780 | A * | 3/1992 | Beuke | B25B 21/005 | 81/57.39 |
| 6,260,444 | B1 * | 7/2001 | Junkers | B25B 21/005 | 81/57.13 |
| D491,436 | S * | 6/2004 | Junkers | D8/61 | |
| 7,062,993 | B2 * | 6/2006 | Shaw | B25B 21/005 | 81/54 |
| 7,497,147 | B2 * | 3/2009 | Koppenhoefer | B25B 21/005 | 81/57.39 |
| 7,520,128 | B1 * | 4/2009 | Rosa | B25B 21/005 | 60/379 |
| 2003/0131691 | A1 * | 7/2003 | Spirer | B25B 23/0078 | 81/57.39 |
| 2004/0200320 | A1 * | 10/2004 | Knopp | B23D 29/005 | 81/57.39 |

* cited by examiner

HYDRAULICALLY OPERATED TIGHTENING TOOL

CROSS REFERENCE TO RELATED APPLICATIONS

This application is a 371 of PCT/ES2012/070536 filed Jul. 16, 2012, which in turn claims the priority of ES P201131212 filed Jul. 15, 2011, the priority of both applications is hereby claimed and both applications are incorporated by reference herein.

FIELD OF THE INVENTION

The present invention relates to a hydraulically operated tightening tool, designed as wrench for tightening and loosening elements that can be fixed by threading, such as large nuts and screws, and more specifically for loosening or tightening threaded elements requiring a high actuation torque.

The object of the present invention is a tool for the described purpose provided with a torque limiter preventing breaks and malfunctions both in the tool itself and in the threaded elements on which it is applied.

The tool of the invention is of the type comprising a body in which there is assembled a hydraulic cylinder and an actuation ring for a threaded element, the ring of which is articulated to the body and eccentrically receives the action of the piston of the hydraulic cylinder for its swiveling, said body further having a reaction base preventing the retraction of the tool.

BACKGROUND OF THE INVENTION

The use of hydraulic wrenches is widespread in the industry since the end of the last century as a result of their versatility and easy handling for performing large turning efforts. Furthermore, using hydraulic wrenches is the only viable option for small spaces or in tall assemblies with a high torque moment. In the beginning these operations were performed with torque wrenches, however the limitation is obvious since they depend on human strength and the ability to construct only levers with finite length for obvious reasons.

To overcome this drawback, mechanical torque multipliers were developed which as a result of using different types and sizes of gears successfully increases the torque in a considerable manner. The use of pneumatic cylinders is also common for increasing the force, but, for the use of large sections of screws, hydraulics is still the most comfortable, economical, transportable and capable way for exerting large tightening efforts in small spaces or difficult to access spaces.

Therefore, the development of these devices has been evolving in line with the use of screws according to the applicable regulations and the advances in the field of hydraulics. Their use is common in large installations which due to transport reasons need to be disassembled or due to access problems require the use of screws and nuts. They can thus be found in facilities where the use of such device is needed such as the oil industry, nuclear industry, heavy machine industry, mining industry, naval industry, wind energy industry, etc.

However, the use of the mentioned devices has the risk of breaks in its mechanisms or of wear of the threaded elements being handled, screws or nuts, due to the involvement of large actuating forces, especially when loosening is performed, where a large amount of energy which the components of the tools used in these operations must endure, is released instantly.

Such tools are used in the following manner: an operator places the hydraulic wrench on the nut, actuating though an impact socket. For performing the tightening or loosening, the wrench in question is fed by a high pressure hydraulic generation system (up to 700 BAR) preferably though flexible connections for increasing comfort.

When the loosening function is performed, at first and given the enormous actuating friction forces, on some occasions the nut overcomes to the friction force, instantly releasing the elastic energy stored in the bolts or screws subjected to traction (this can be 90% of the effort made). The stresses are previously balanced due to the reduced angle of the threads of the screw and the nut. When the nut is released violently it exerts a large instant impact until the friction force acts once more and balances again, the angular rotation caused by this phenomenon is very small but sufficient for damaging the pull-back system assuring that the block, the torque transmission system and the thrusting piston return together to the start position once the retraction occurs for performing another cycle. The torque transmission system of the piston is thus separated with great violence, breaking the pull-back system since it is not sized for instantaneous forces of such magnitude.

The use of fuse elements which break when the force applied by the tool exceeds a pre-established limit is known for eliminating these problems. The break of the fuse requires subsequent disassembling and replacing the parts or elements broken when the force for which they are designed is exceeded.

DESCRIPTION OF THE INVENTION

The object of the present invention is to eliminate the problems set out by means of a hydraulically operated tightening tool which, without the need of using fuse elements, prevents the application of forces above a pre-fixed value, thus eliminating the risk of breaking both the mechanisms of the tool and the threaded components being handled.

The tool of the invention is of the type initially indicated and is characterized in that the head of the piston of the hydraulic cylinder has two parallel tabs integral to said piston axially protruding from same. The actuating ring for the threaded element is assembled in an articulated manner between these two tabs. The ring is articulated between the mentioned tabs by means of a spring with an elastically variable length which perpendicularly traverses the ring and protrudes partially from same at both sides. The tabs integral to the piston of the hydraulic cylinder have on their facing surfaces respective arched transverse matching grooves, in which there are housed the protruding ends of the articulation spring between the ring and tabs. The mentioned grooves open on its end sections through the longitudinal edges of the tabs.

The articulation spring between the ring and tabs is located between the actuation point of the piston of the hydraulic cylinder on the ring and the element or component of said actuating ring on the threaded element.

Having described the constitution, the linear movement of the piston of the hydraulic cylinder is converted into a rotary movement of the ring about the articulation spring with the integral tabs of said piston. During the rotation, the articulation spring between the ring and tab will move in one direction or another along the grooves of the tabs to the proximities of one of its end sections. If the force applied is greater than the pre-fixed value, the movement of the articulation spring is greater than the corresponding length of the grooves, the spring coming out from same through one of the end sections thereof and thus ceasing force transmission between the tool and the threaded elements which it actuates.

The articulation spring between the ring and tabs can be made up of a helical spring and of two spheres resting on the ends of the spring, one on each side thereof. This spring traverses the ring perpendicularly through a borehole having a diameter approximately equal to that of the mentioned spring. Each sphere is retained by a cage fixed to the ring, with the spring being compressed, and from which it partially protrudes into caps which are housed in the grooves of the tabs.

The cages responsible for retaining the spheres can be made up of two plates, each plate housed and fixed in a slot of the ring on its opposite surfaces in matching positions. These plates will have a circular hole with a diameter less than that of the sphere, through which hole each sphere will protrude partially to be housed in the facing groove.

Preferably between the mentioned tabs there is arranged a thrusting part on which the ring rests, a part which will in turn rest on the piston of the hydraulic cylinder.

BRIEF DESCRIPTION OF THE DRAWINGS

The attached drawings show a tool made according to the invention and provided by way of non-limiting example. In the drawings.

DETAILED DESCRIPTION OF AN EMBODIMENT

Figure 1:
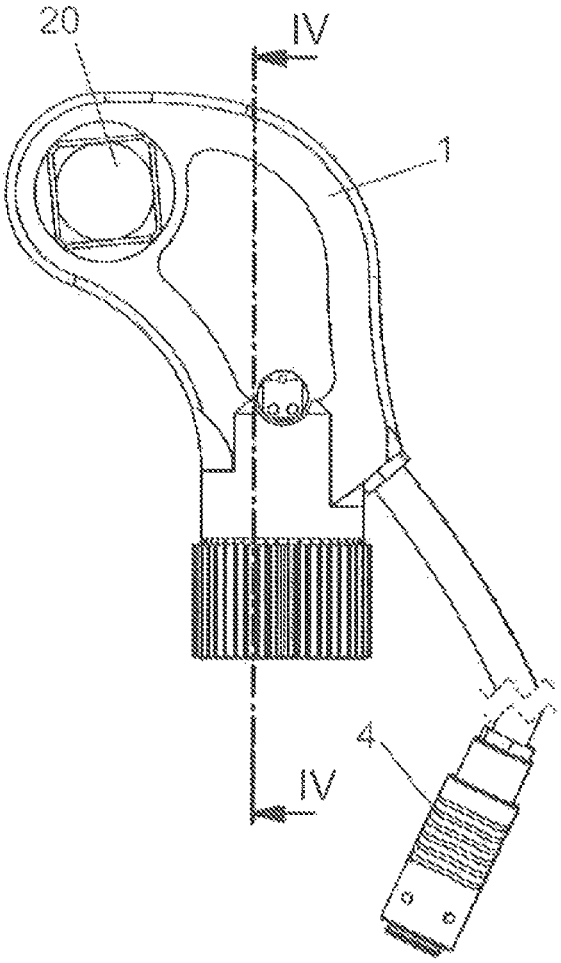
FIG. 1 is a side elevational view of a tool including the features of the invention.

The constitution, features and advantages of the tool of the invention will be better understood with the following description of the embodiment shown in the drawings attached.

Figure 2:
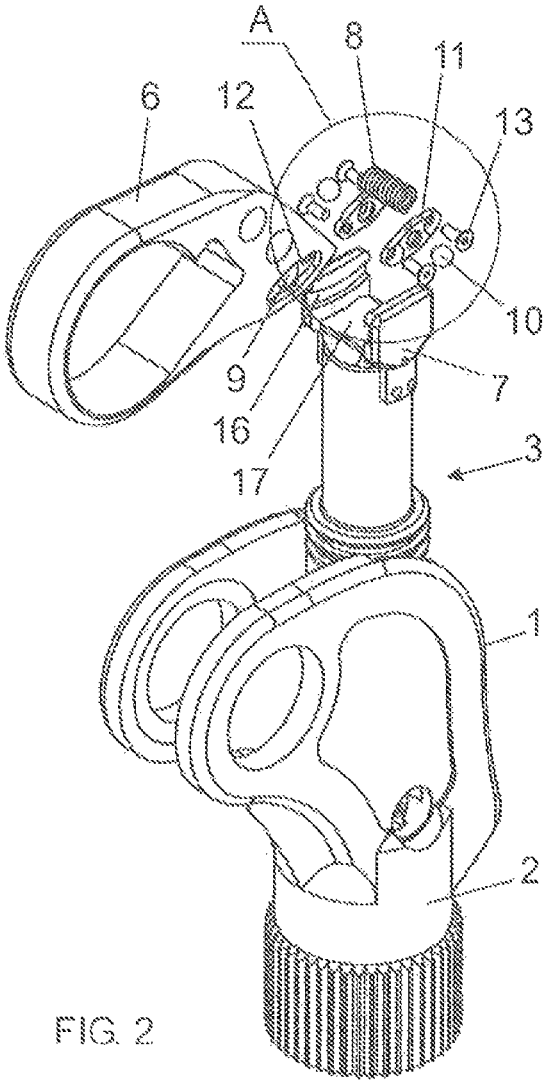
FIG. 2 is an exploded perspective view of the tool of FIG. 1.
Figure 3:
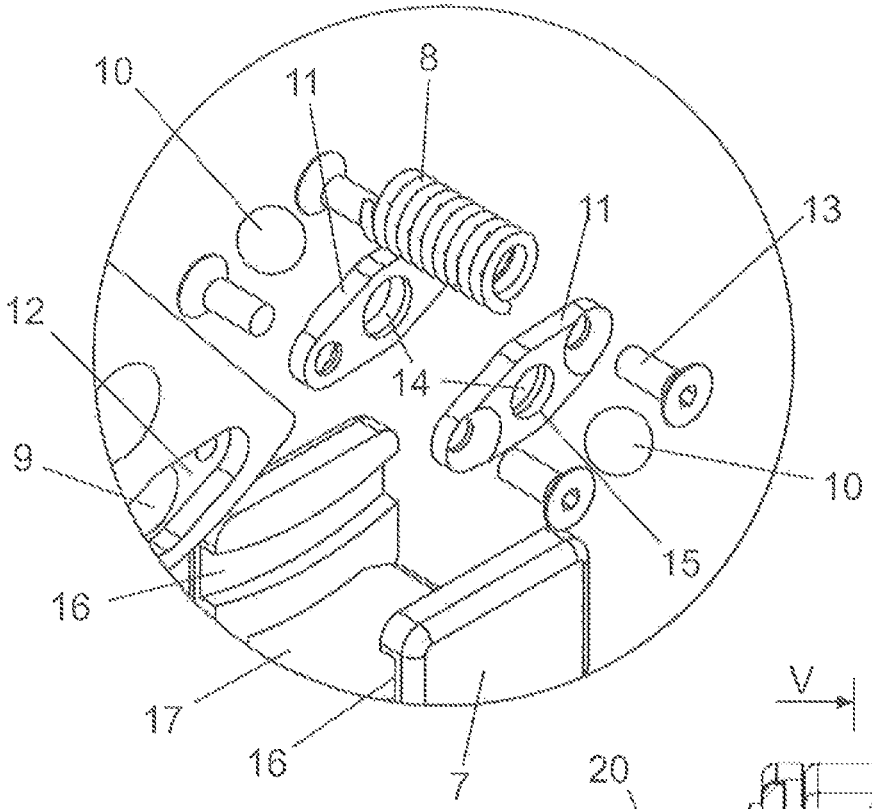
FIG. 3 corresponds to detail A of FIG. 2 on a larger scale.
Figure 8:
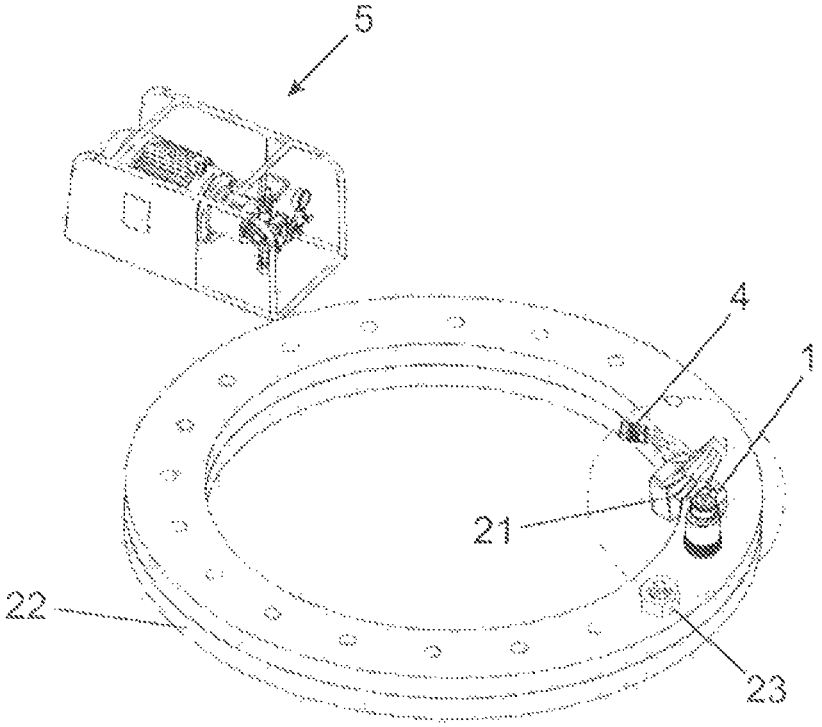
FIG. 8 shows the perspective view of the way of applying the tool of the invention, with the reaction base included in FIG. 7.

FIGS. 1 to 3 show a tool comprising a body 1 demarcating a chamber 2 in which there is housed a piston 3 forming a hydraulic cylinder provided with connections 4 for connecting the hydraulic fluid from a hydraulic generation centre 5, FIG. 8.

An actuating ring 6 for a threaded element is further assembled in body 1. This ring 6 is articulated inside the body 1 and receives the action of the piston 3 eccentrically with respect to the position of the articulation spring of the ring for swiveling same.

According to the present invention, the ring 6 is assembled in an articulated manner at the end of the piston 3 by means of two tabs 7 which are integral with said piston and protrude from same axially. The actuating ring 6 is inserted between these tabs and is articulated therebetween by means of a spring with an elastically variable length which, in the example depicted in the drawings, is made up of a helical spring 8 traversing the actuating ring perpendicularly 6 through a borehole 9 having a diameter approximately equal to that of the spring 8. Respective spheres 10 each of them retained by a cage in the form of plates 11 housed and fixed in slots 12 of the actuating ring 6 on its side surfaces in matching positions, rest at the ends of this spring 8. The plates 11 can be fixed on the slots 12 by means of screws or rivets 13. These plates 11 will further have a central hole 14 which can have therein a spherical surface having radius coinciding with that of the spheres 10 and with an outer circular opening 15 having a radius less than that of said spheres.

Once the set described is assembled in the actuating ring 6, the spring 8 is compressed, the spheres 10 protruding partially through the opening 15 of the holes 14.

The tabs 7, between which there is assembled the actuating ring 6, have, on their facing surfaces, respective arched transverse matching grooves 16 opening at their end sections through the longitudinal edges of the tabs 7. The caps or portions of the spheres protruding through the openings 15 of holes 14 of plates 11 penetrate these grooves 16.

Figure 4:
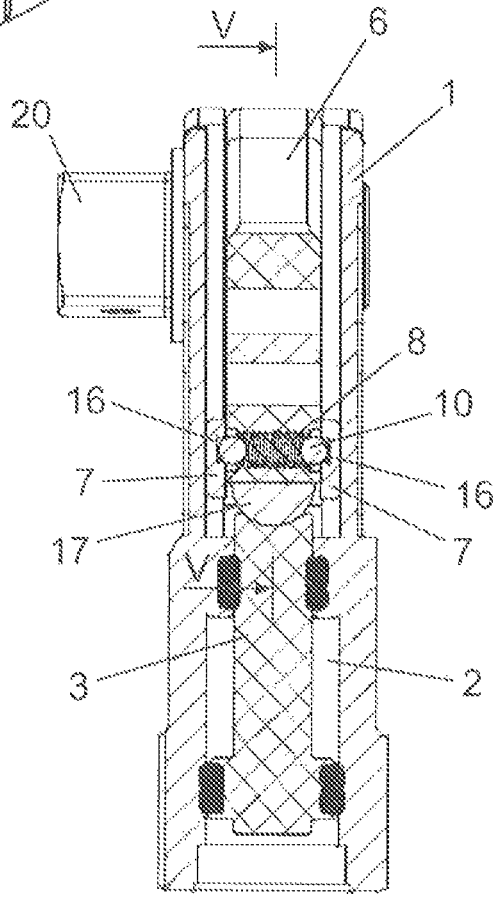
FIG. 4 is a longitudinal section of the tool taken according to section line IV-IV of FIG. 1.

Between the tabs 7 there is further arranged a thrusting part 17 resting on the piston 3 on which the actuating ring rests 6, all this as can be better seen in FIG. 4, in which the hydraulic cylinder is also seen, the hydraulic cylinder is made up of chamber 2 and piston 3 with tabs 7 integral thereto, which tabs define the grooves 16 in which there are housed partially the spheres 10 which, together with the spring 8, form the articulation spring for articulating the actuating ring 6 on the tabs 7.

Figure 5:
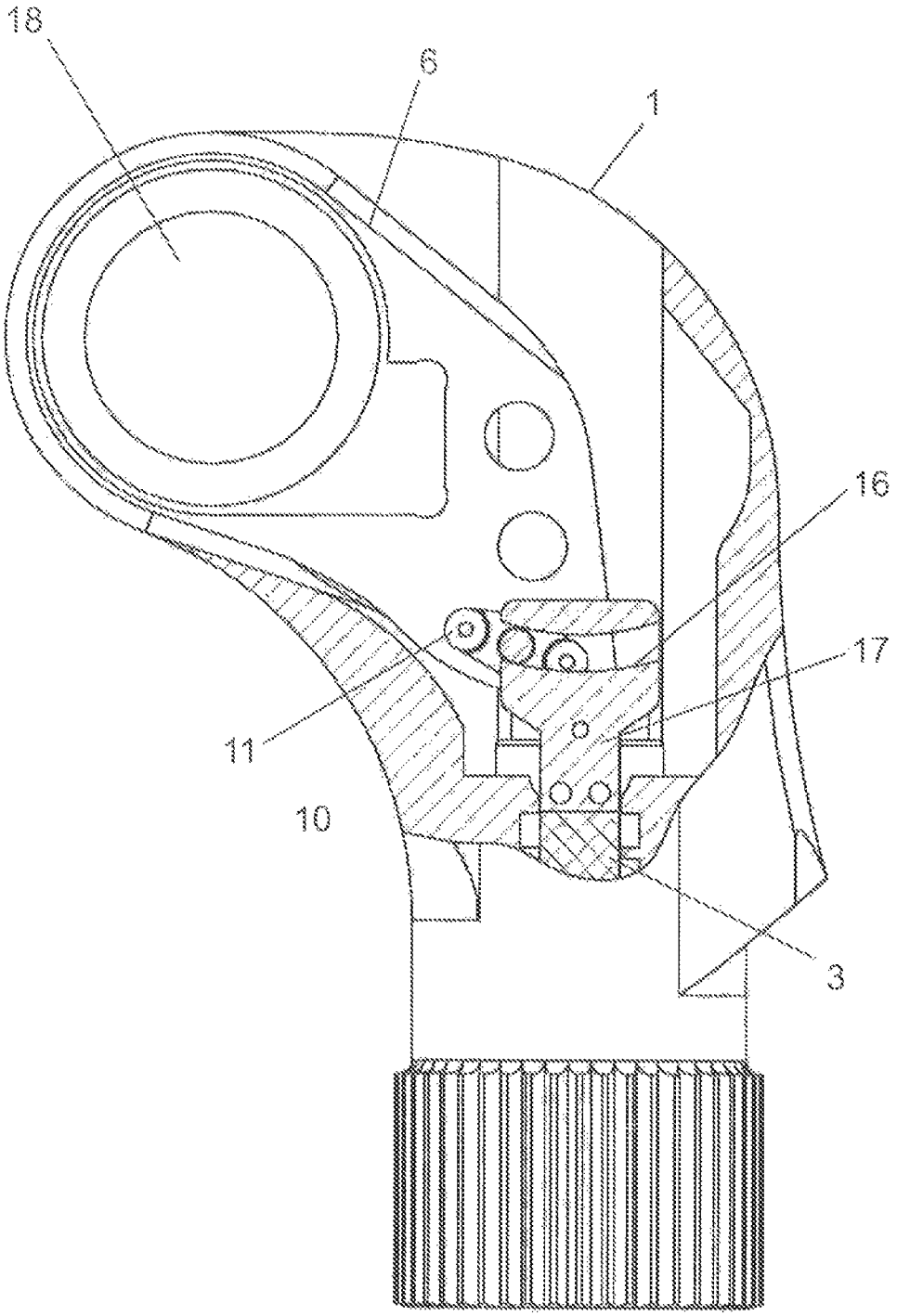
FIG. 5 is a partial section view of the tool taken according to section line V-V of FIG. 4.
Figure 6:
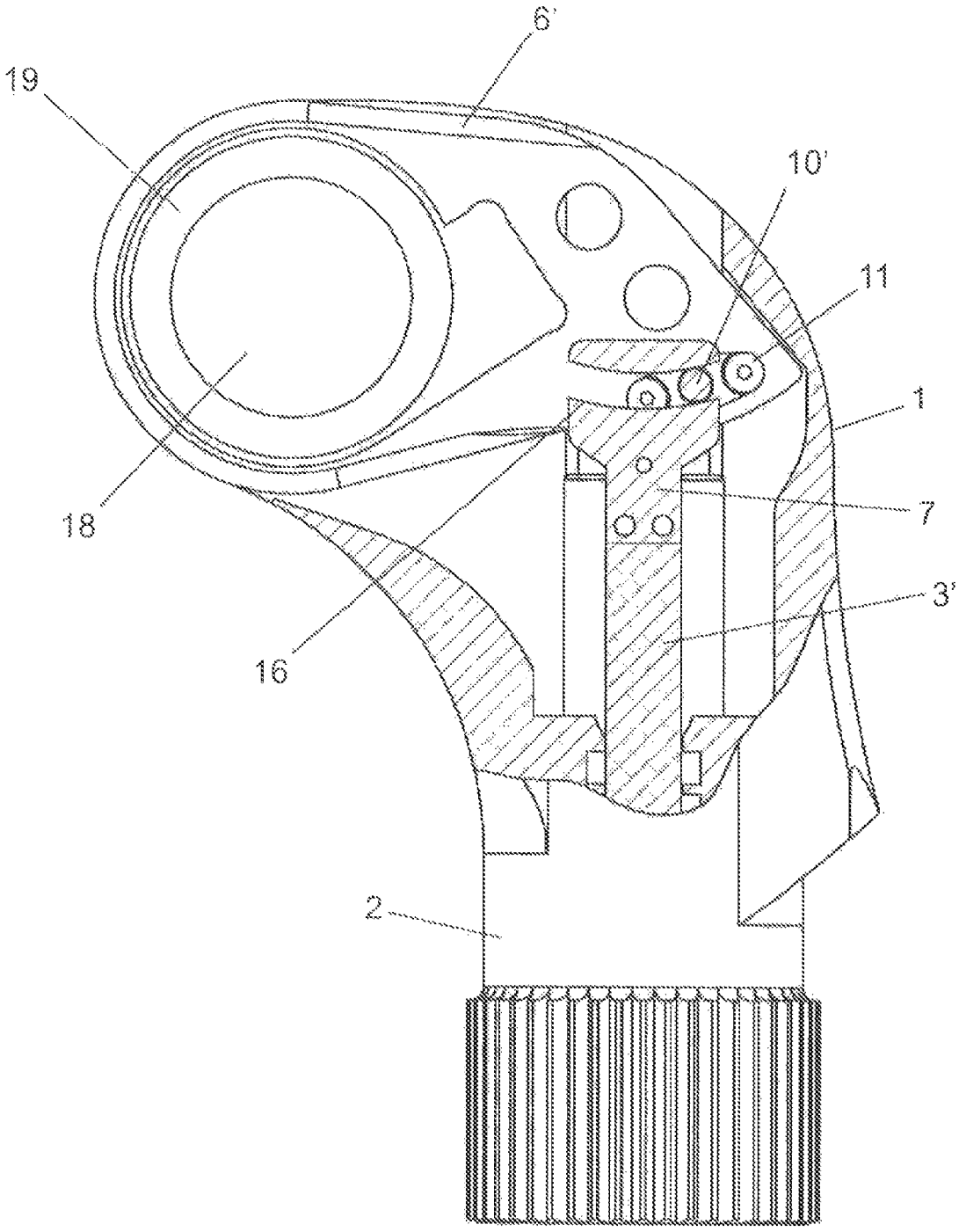
FIG. 6 is a view similar to FIG. 5 with the piston of the hydraulic cylinder in a position of maximum extraction.

When the piston 3 is in the retracted position of FIG. 4, the actuating ring 6 occupies the position depicted in FIG. 5, in which the spheres 10 are located at one of the ends of the grooves 16. When the piston 3 moves forward until occupying a position of maximum extraction shown in FIG. 6, the actuating ring 6 will have rotated about the articulation spring established in the spheres 10 which will have moved along the grooves 16 until occupying position 10' of FIG. 6. The linear movement of the piston of the hydraulic cylinder from position 3 of FIG. 5 to position 3' of FIG. 6 will have swiveled the actuating ring from position 6 of FIG. 5 to position 6' of FIG. 6, rotating about the center 18 of the base 19 on which there is fixed the square 20 on which there can be coupled the socket with a size corresponding to the nut or screw on which the tool is to be coupled.

When the force from actuating the tool exceeds a pre-fixed value during the operation of tightening or loosening a nut or screw, the balls 10 of the articulation spring between the actuating ring 6 and the tabs 7 exceed the end sections of the grooves 16, coming out from same and ceasing at this time the transmission force between the piston 3 of the hydraulic cylinder and the square 20 having the corresponding socket for actuating the nut or screw.

Breaks or deteriorations in the components of the tool or of the threaded elements which it actuates are thus prevented. By means of backing away slightly from the position reached, the spheres 10 are housed again in the grooves 16, the tool being ready for new actuation.

Figure 7:
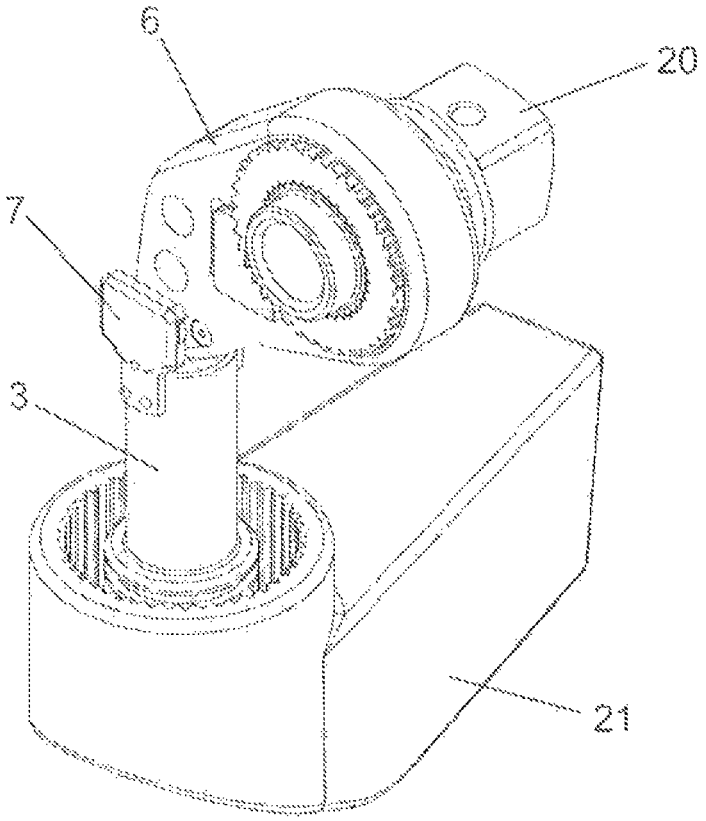
FIG. 7 shows the perspective view the tool of the invention with a reaction base applied thereon and with the given tightening holders for a nut or screw.

As shown in FIG. 7 a reaction base 21 is coupled on the described tool, which reaction base 21, as depicted in FIG.

8, rests at a fixed point of the structure 22 having the nuts to be tightened. Pressurized fluid is fed to the chamber 2 of the hydraulic cylinder of the tool by means of the hydraulic generation center 5 and through the connectors 4, causing the piston 12 to move in one direction or another, the rectilinear movement of which is converted into a circular movement in the actuating ring 6 which allows rotating the dice 20, FIG. 4 and thereby the socket fitted therein for actuating the nut 23. To assure that rotation about the nut does not occur in the wrench, the reaction base 21 resting at a fixed point of the structure 22 is provided.

As discussed above, when a nut is to be loosened, there are cases where in view of the enormous tension to which the nut is subjected in the set formed by the screw and nut, friction force is overcome and it suddenly rotates faster than the actuating ring 6, dragging it in a first instant until the friction force balances again. Since the piston 3 moves slower and does not accompany the actuating ring 6 because the hydraulic fluid prevents same, said ring detaches from the tabs 7 when the spheres 10 come out of the grooves 16, thus preventing breaks or deteriorations from occurring in the system. Once the force ceases, the spheres 10 fit in the grooves 16 again because the force for loosening the nut continues being considerable.

The invention claimed is:

1. A hydraulically operated tightening tool comprising:

a body comprising a hydraulic cylinder, the hydraulic cylinder comprising a piston, the piston comprising a head, wherein first and second tabs protrude from the head of the piston, wherein the first tab comprises a first arched groove, wherein the second tab comprises a second arched groove, the first and second arched grooves being transverse and facing each other, the first and second arched grooves opening at respective end sections through respective longitudinal edges of the first and second tabs, the piston having a first, retracted, position and a second, extended, position;

an actuating ring for a threaded element, the actuating ring being articulated with respect to the body and adapted to receive an action of the piston of the hydraulic cylinder a spring having a first end and a second end, and an elastically variable length the spring being disposed in a manner to traverse the actuating ring perpendicularly first and second elements disposed respectively at first and second ends of the spring, wherein the first element protrudes from a first end of the actuating ring and fits in the first arched groove, wherein the second element protrudes from a second end of the actuating ring and fits in the second arched groove;

wherein the actuating ring is articulated via the spring, the first element, and the second element; and a thrusting part disposed between the first and second tabs, the thrusting part resting on the piston of the hydraulic cylinder, wherein the actuating ring rests on the thrusting part wherein:

the first element is disposed at a first end of the first arched groove and the second element is disposed at a second end of the second arched groove, the second end corresponding to the first end, when the piston is in the first, retracted position; and the first element is disposed at a third end of the first arched groove and the second element is disposed at a fourth end of the second arched groove, the third end corresponding to the fourth end, when the piston is in the second, extended, position.

2. A hydraulically operated tightening tool comprising a body in which there is assembled a hydraulic cylinder and an actuating ring for a threaded element, the actuating ring of which is articulated to the body and receives the action of the piston of the hydraulic cylinder for its swiveling, characterized in that two parallel tabs axially protrude from the head of the piston of the hydraulic cylinder between which tabs there is a spring with an elastically variable length, the actuating ring being articulated on the spring; the spring of which traverses the actuating ring perpendicularly and protrudes partially from same on both sides; and the tabs of which have respective arched transverse facing grooves, in which there are housed the ends of the mentioned spring, said grooves opening at their end sections through the longitudinal edges of the tabs, and in that between the tabs there is arranged a thrusting part on which the actuating ring rests, the part of which in turn rests on the piston of the hydraulic cylinder, wherein the spring with an elastically variable length is made up of a helical spring and of two spheres resting on the ends of the spring, one on each end, the spring of which traverses the actuating ring perpendicularly through a borehole having a diameter approximately equal to that of the mentioned spring; and each sphere being retained by a cage fixed to the ring, with the spring being compressed, and partially protrude into caps which are housed in the grooves of the tabs.

3. A hydraulically operated tightening tool comprising a body in which there is assembled a hydraulic cylinder and an actuating ring for a threaded element, the actuating ring of which is articulated to the body and receives the action of the piston of the hydraulic cylinder for its swiveling, characterized in that two parallel tabs axially protrude from the head of the piston of the hydraulic cylinder between which tabs there is a spring with an elastically variable length, the actuating ring being articulated on the spring; the spring of which traverses the actuating ring perpendicularly and protrudes partially from same on both sides; and the tabs of which have respective arched transverse facing grooves, in which there are housed the ends of the mentioned spring, said grooves opening at their end sections through the longitudinal edges of the tabs, and in that between the tabs there is arranged a thrusting part on which the actuating ring rests, the part of which in turn rests on the piston of the hydraulic cylinder, wherein the mentioned cages are made up of two plates, each plate housed and fixed in a slot of the actuating ring on its opposite surfaces and in matching positions, the plates of which have a circular central hole the outer opening of which is of a diameter less than that of the spheres, through which hole each sphere protrudes partially into a portion which is housed in the grooves.

* * * * *